US008070075B2

(12) United States Patent
Schmidt et al.

(10) Patent No.: US 8,070,075 B2
(45) Date of Patent: Dec. 6, 2011

(54) SANITARY WATER-OUTFLOW FITTING

(75) Inventors: Heinz Schmidt, Stuttgart (DE); Werner Weinmann, Filderstadt (DE)

(73) Assignee: Hansa Metallwerke AG (DE)

( * ) Notice: Subject to any disclaimer, the term of this patent is extended or adjusted under 35 U.S.C. 154(b) by 522 days.

(21) Appl. No.: 12/158,629

(22) PCT Filed: Oct. 21, 2006

(86) PCT No.: PCT/EP2006/010174

§ 371 (c)(1),
(2), (4) Date: Jun. 20, 2008

(87) PCT Pub. No.: WO2007/079799

PCT Pub. Date: Jul. 19, 2007

(65) Prior Publication Data

US 2008/0289708 A1 Nov. 27, 2008

(30) Foreign Application Priority Data

Dec. 23, 2005 (DE) ..... 10 2005 061 974

(51) Int. Cl.
*B05B 1/20* (2006.01)

(52) U.S. Cl. ..... 239/566; 239/16; 239/18; 239/548; 239/597; 4/507; 4/591; 4/678; 362/96

(58) Field of Classification Search ..... 239/16–18, 239/548, 566, 597; 4/507, 591, 678; 362/96
See application file for complete search history.

(56) References Cited

U.S. PATENT DOCUMENTS

| | | | | |
|---|---|---|---|---|
| 3,272,233 | A | 9/1966 | Trufitt | |
| 5,738,280 | A * | 4/1998 | Ruthenberg | 239/17 |
| 5,893,179 | A * | 4/1999 | Johnson | 4/507 |
| 6,196,471 | B1 * | 3/2001 | Ruthenberg | 239/18 |
| 6,286,808 | B1 | 9/2001 | Slothower et al. | |
| 6,450,418 | B1 * | 9/2002 | Simpson et al. | 239/17 |
| 6,595,675 | B2 * | 7/2003 | Dongo | 362/96 |
| 7,229,027 | B2 * | 6/2007 | Ehresman et al. | 239/18 |
| 2005/0086733 | A1 | 4/2005 | Li | |
| 2006/0021127 | A1 * | 2/2006 | Li et al. | 4/507 |

FOREIGN PATENT DOCUMENTS

| | | |
|---|---|---|
| DE | 20 2005 003 910 | 12/2005 |
| NL | 1 018 841 | 3/2003 |
| WO | WO 2004/083537 | 9/2004 |

OTHER PUBLICATIONS

International Search Report issued in corresponding International application No. PCT/EP010174 dated Jan. 2, 2007.

* cited by examiner

*Primary Examiner* — Steven J Ganey
(74) *Attorney, Agent, or Firm* — Lempia Summerfield Katz LLC

(57) ABSTRACT

The description is given of a sanitary water-outflow fitting, in particular a tub-filling mixer unit, having a water-outflow housing (1) and a jet former for a wide-surface-area water-outlet jet (19), the jet former being arranged in the housing. The water-outflow housing (1) comprises an elongate supply channel (21) which runs essentially perpendicularly to the water-outlet jet (19), tapers in a funnel like manner in the throughflow direction and is bounded by an intermediate wall (37). The intermediate wall (37) has a multiplicity of throughflow holes (51), via which the supply channel (21) is connected to an elongate distributor chamber (11) essentially parallel to it. The distributor chamber (11) has at least one water-outlet channel (9) leading to the water outflow.

20 Claims, 9 Drawing Sheets

SANITARY WATER-OUTFLOW FITTING

The invention relates to a sanitary water-outflow fitting, in particular a bathtub-filling mixer unit, having a water-outflow housing and a jet former for a wide-surface-area water-outlet jet arranged therein.

In commercially known water-outflow fittings, such jet formers are used to produce a uniformly wide, homogenous water jet at the water outflow for aesthetic and/or functional reasons.

For example, known bathtub-filling mixer units have wide bath inlets which have a visually attractive design and, moreover, permit a large volumetric flow of discharged water, so that a bath may be rapidly filled.

Even in known surge flow shower heads it is desirable to pass a uniform water jet over the entire width of the flat, open water outflow which may be made of glass.

In order to produce a wide-surface-area jet, rectangular sieves have been hitherto used at the transition of a closed, flat, rectangular water outflow with the open water outflow. However, such sieves are very easily soiled.

For stabilising wide-surface-area jet formers it was hitherto required to pass the wide jet over a sufficiently long distance before it flowed further in the open water outflow. For flush-mounted fittings, for example for flush-mounted bathtub mixer units or flush-mounted surge flow shower heads, however, only a limited amount of space is available perpendicular to the mounting wall.

It is the object of the present invention to design a sanitary water-outflow fitting of the aforementioned type with an overall depth perpendicular to the mounting wall which is as small as possible and a visually attractive design, by means of which a uniform wide-surface-area water-outlet jet may be produced.

This object is achieved according to the invention by the water-outflow housing comprising an elongate supply channel extending substantially perpendicular to the water-outlet jet, which tapers in a funnel-like manner in the throughflow direction and is bounded by a intermediate wall which comprises a plurality of throughflow holes, via which the supply channel is connected to an elongate distributor chamber substantially parallel thereto, which has at least one water-outlet channel leading to the water outflow.

According to the invention, therefore, the supply channel and the distributor chamber are arranged transversely to the water-outlet jet, so that the water-outflow housing has a smaller overall depth. As a result of the tapering it is achieved that when the water flow is initially deflected in the water-outflow housing, the water is uniformly distributed along the intermediate wall, i.e. transversely to the water-outlet jet and the water pressure remains approximately constant along the supply channel. From there, it flows towards the distributor chamber, transversely to the water-outlet jet, through the throughflow holes, uniformly over the length of the distributor chamber. In the water-outlet channel(s) of the distributor chamber a second deflection of the water flow takes place in the direction of the water outflow.

In order to improve the homogeneity of the water-outlet jet, the supply channel, the intermediate wall and the distributor chamber may be approximately as long as the width of the water-outlet jet and the throughflow holes may be distributed over the entire surface of the intermediate wall.

Expediently, the throughflow holes may be located offset to one another on parallel lines, whereby a particularly uniform distribution of the throughflow holes may be produced over the surface of the intermediate wall.

Moreover, the throughflow holes may be of honeycombed configuration. In this manner, an almost uniform throughflow may be produced over the entire surface of the intermediate wall, which leads to the stabilising of the water flow.

In a further advantageous embodiment, the supply channel and the distributor chamber may have a rectangular cross section, the throughflow holes may extend perpendicular through the intermediate wall and the water-outlet channel may extend perpendicular to the throughflow holes. The rectangular supply channel and the rectangular distributor chamber are able to be arranged on top of one another in a particularly space-saving manner. As a result of the perpendicular arrangement of the throughflow holes, it is achieved that the flow direction is deflected by 90° and the water flows perpendicular to the intermediate wall in the distributor chamber, so that water flowing in the longitudinal direction of the distributor chamber and turbulence are substantially avoided. The water flows out of the distributor chamber through the water-outlet channel(s) extending perpendicular to the throughflow holes towards the water outflow; the water flow is in this case, therefore, again deflected by 90° into the plane of the water-outlet jet.

In order to permit a closed carpet of water, in particular in the water outflow, a plurality of, in particular rectangular, water-outlet channels may be arranged adjacent to one another. The rectangular shape permits an almost continuous arrangement in series.

In order to increase the flow velocity at the transition to the water outflow, the at least one water-outlet channel may comprise in the direction of water flow at least one, in particular step-like or funnel-shaped, narrowing.

The intermediate wall may be an insert which may be simply mounted in the water-outflow housing. In this manner, intermediate walls with different arrangements and/or sizes of throughflow holes may be inserted in a modular manner into the water-outflow housing. Also, the intermediate wall may, for example, be easily removed for cleaning purposes.

The water-outflow housing may have at least one lamp receiving space with at least one light window facing the water outflow. In the lamp space are arranged lamps for illuminating the emerging water and/or an in particular transparent water outflow, for example made of glass.

An embodiment of the invention is explained hereinafter in more detail with reference to the drawings, in which.

Figure 1:
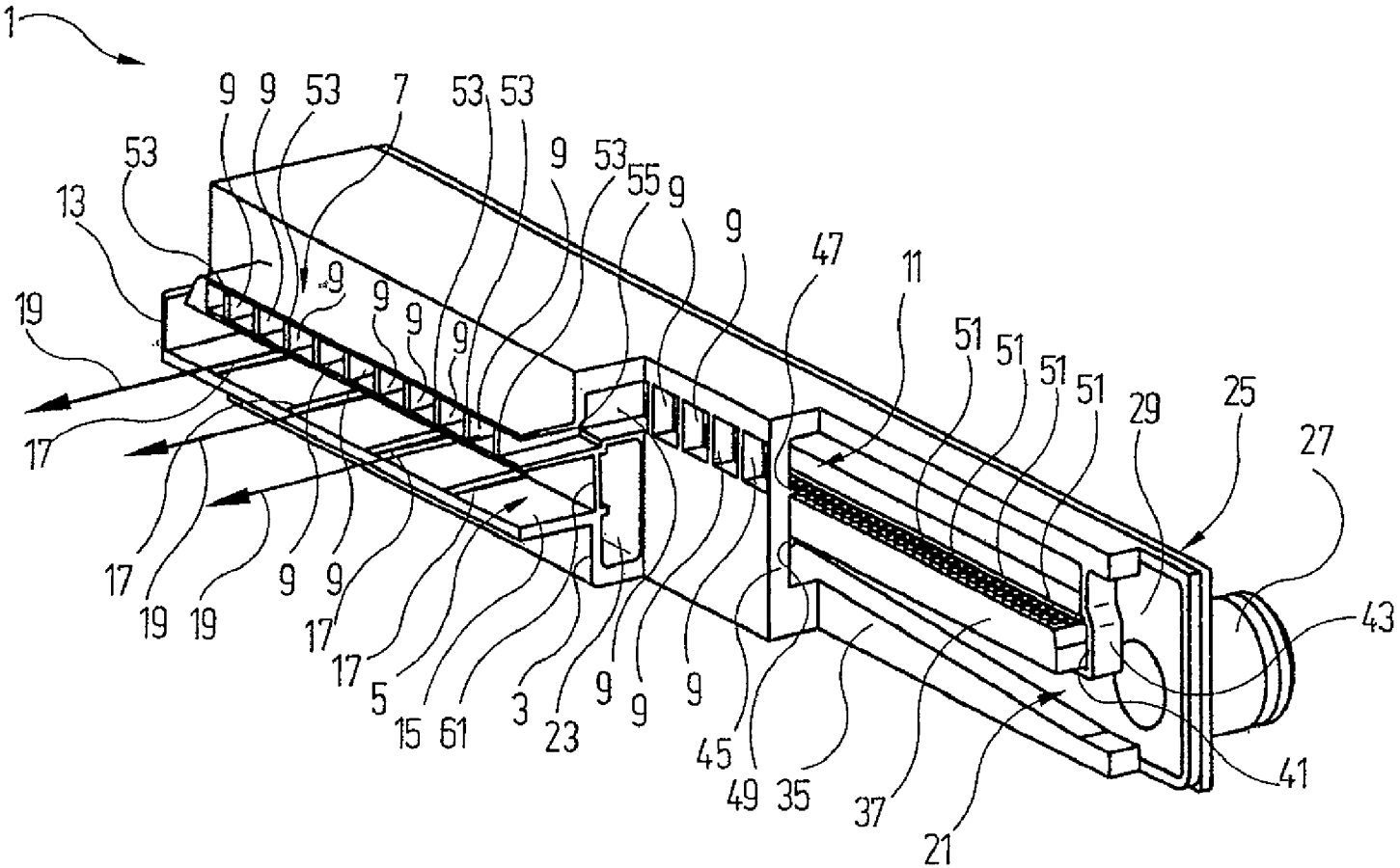
FIG. 1 shows schematically a partial sectional isometric view of a water outflow housing viewed obliquely from the front right, looking towards the water outflow side.
Figure 2:
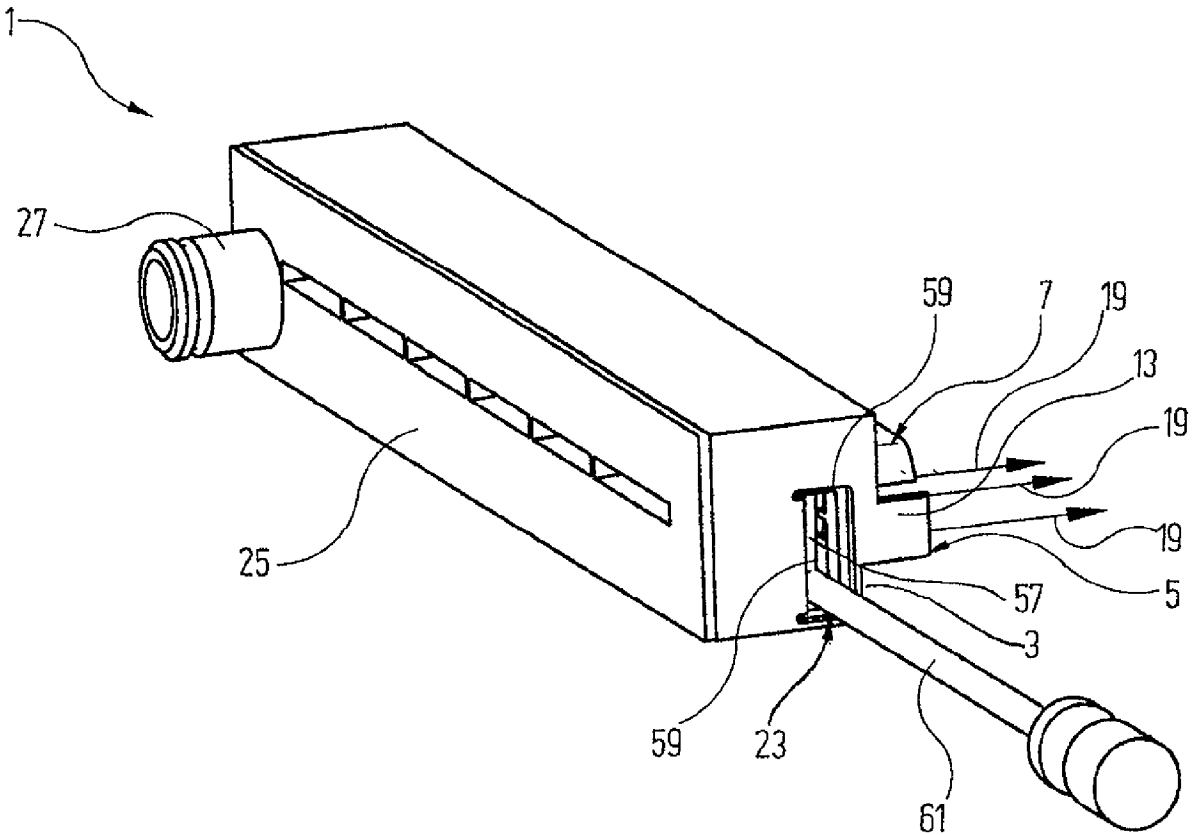
FIG. 2 shows schematically the water-outflow housing of FIG. 1 looking towards the rear face thereof.
Figure 3:
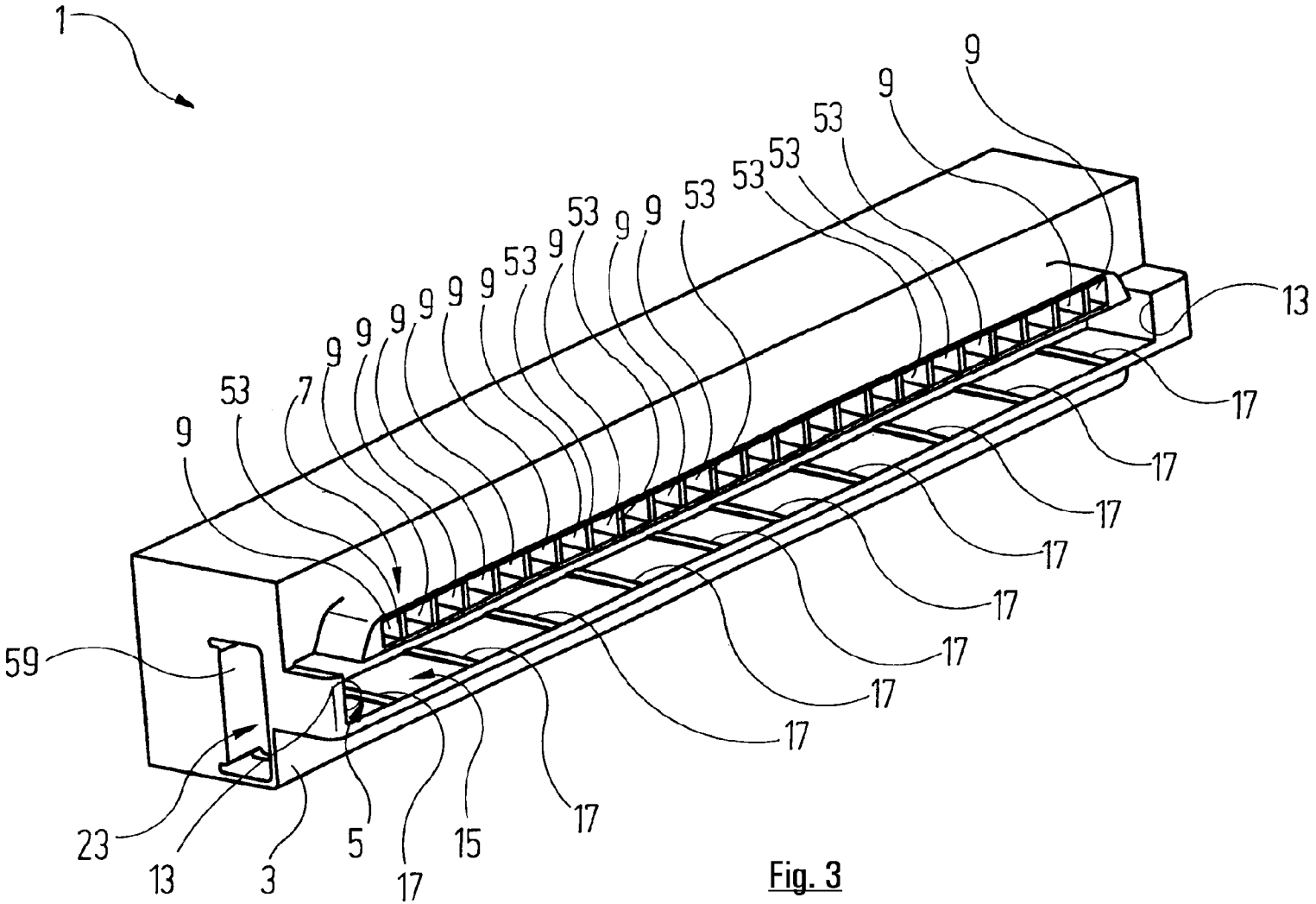
FIG. 3 shows schematically the water-outflow housing of FIG. 1 viewed obliquely from the front left.
Figure 4:
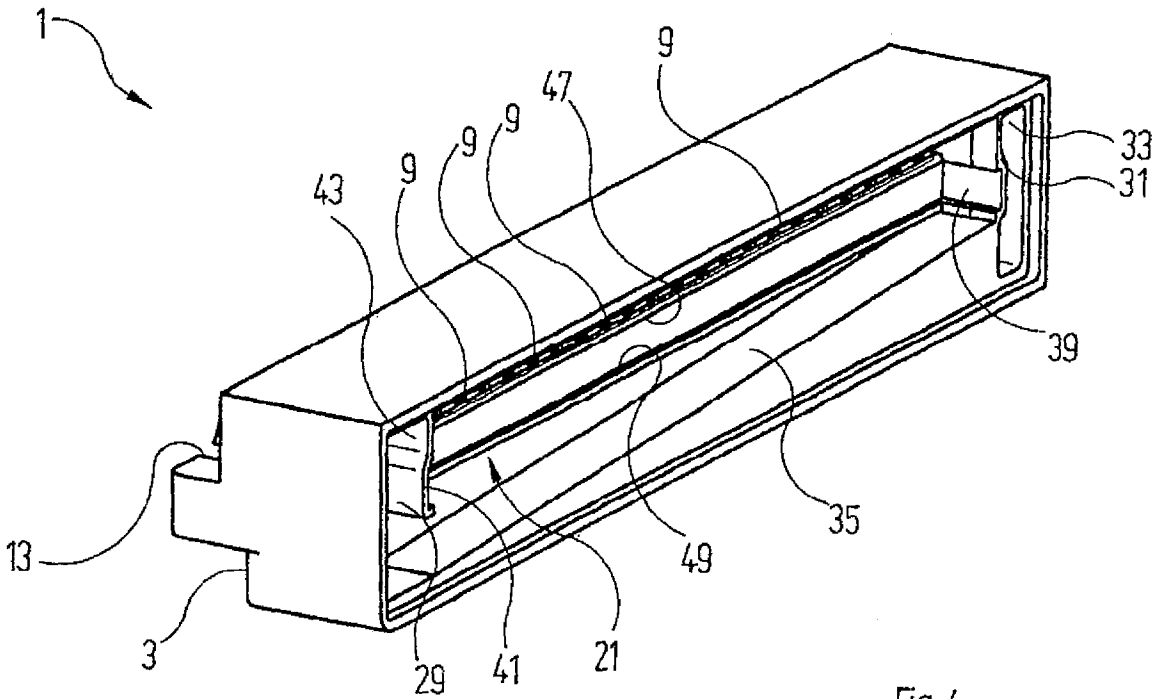
FIG. 4 shows schematically the water-outflow housing of FIG. 1 looking towards the rear face thereof, in this case with the rear wall removed.
Figure 5:
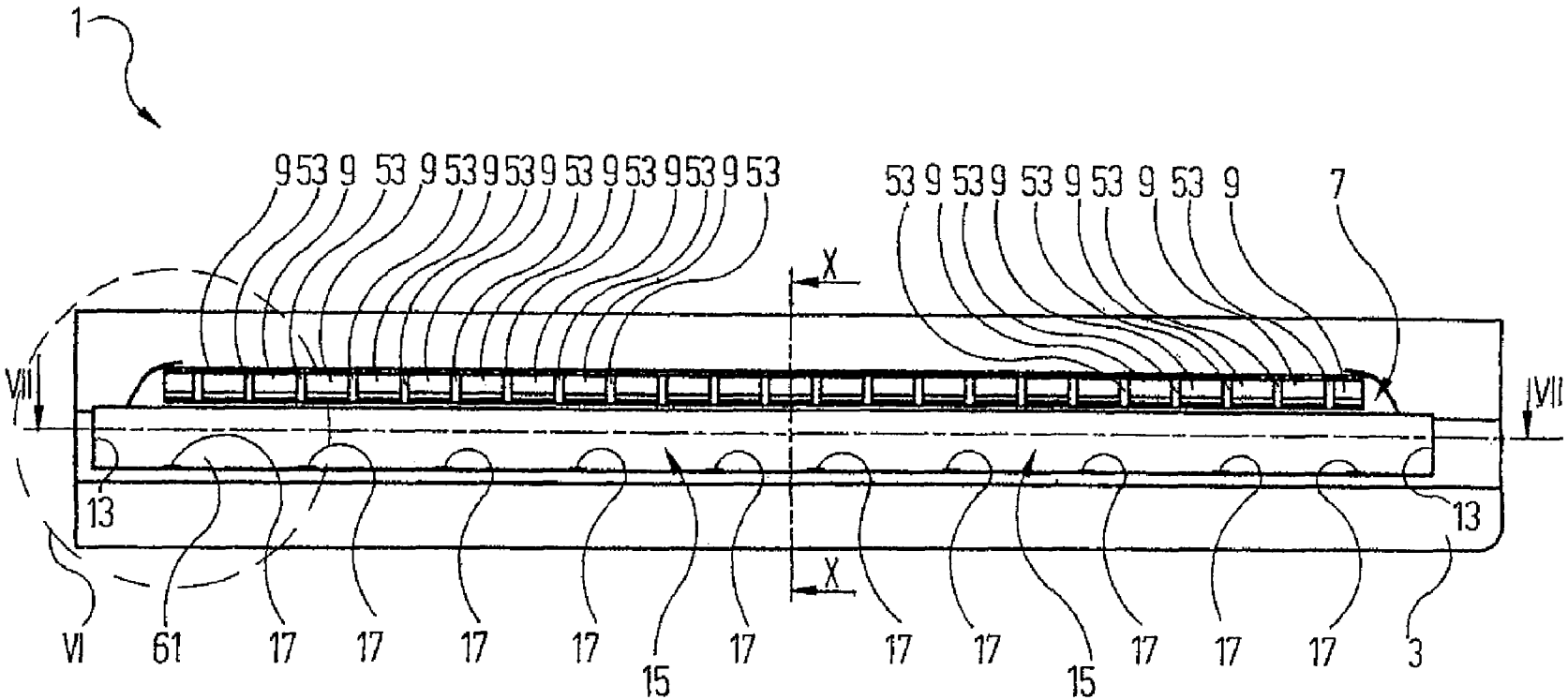
FIG. 5 shows schematically the front view of the water-outflow housing of FIG. 1.
Figure 6:
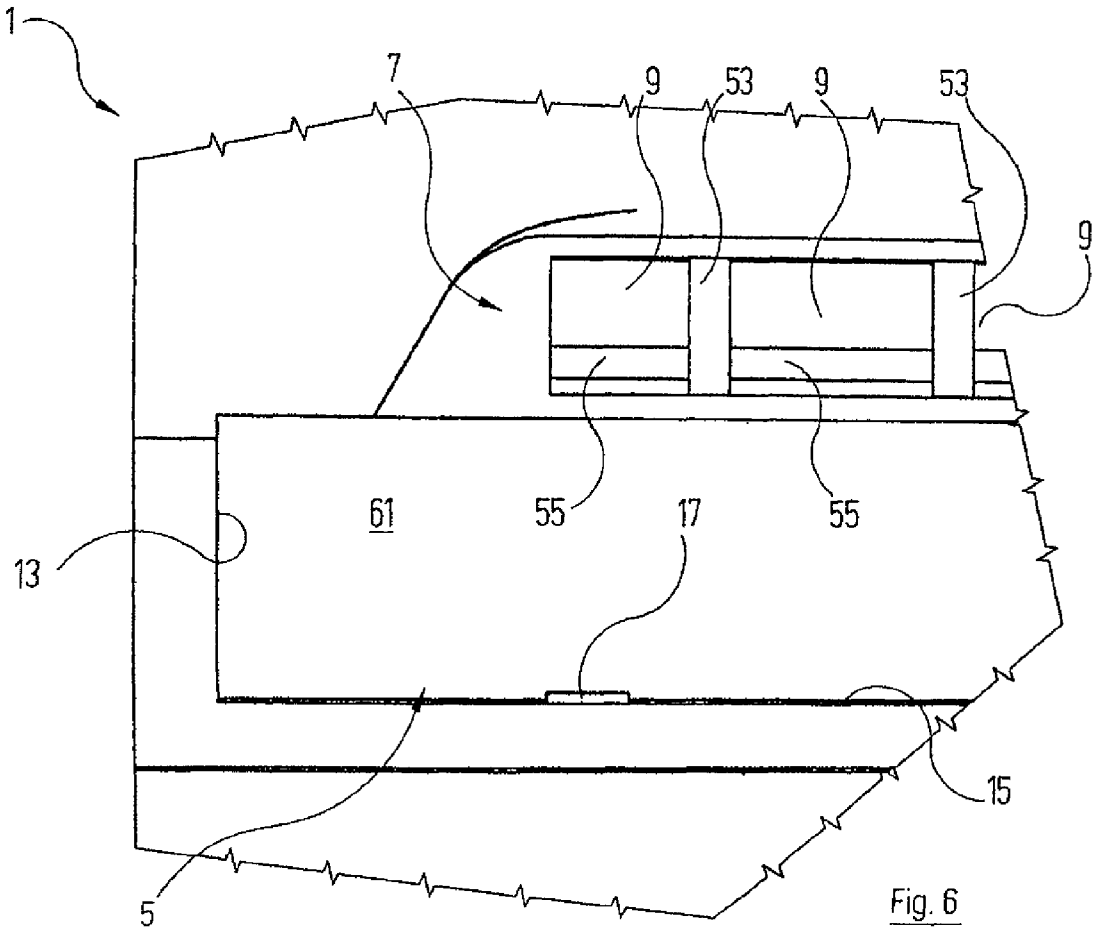
FIG. 6 shows schematically the water-outflow housing of FIG. 5 in detail in the region VI there.
Figure 7:
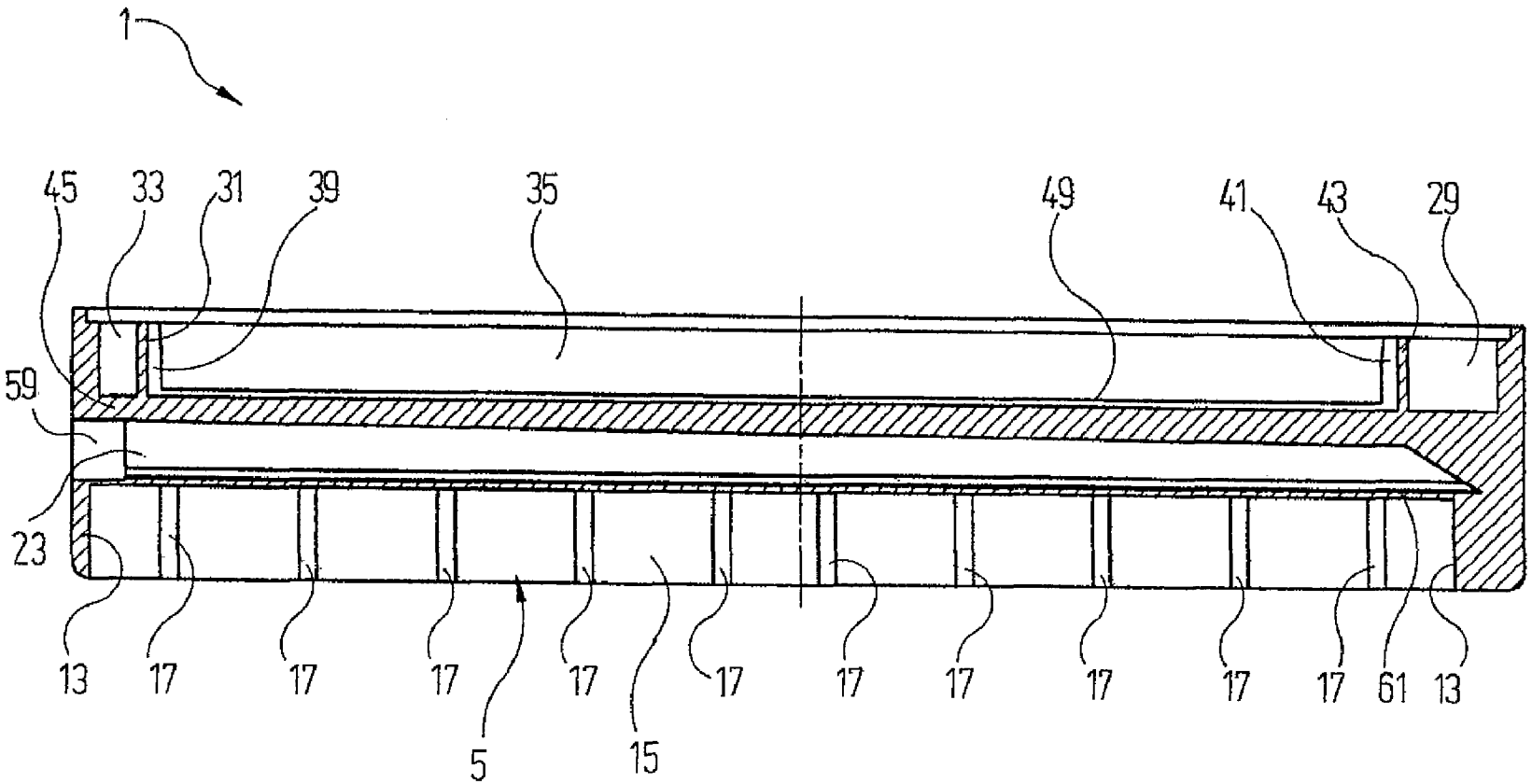
FIG. 7 shows schematically a longitudinal section of the water-outflow housing of FIG. 5 along the line VII-VII there, in this case without a rear wall.
Figure 8:
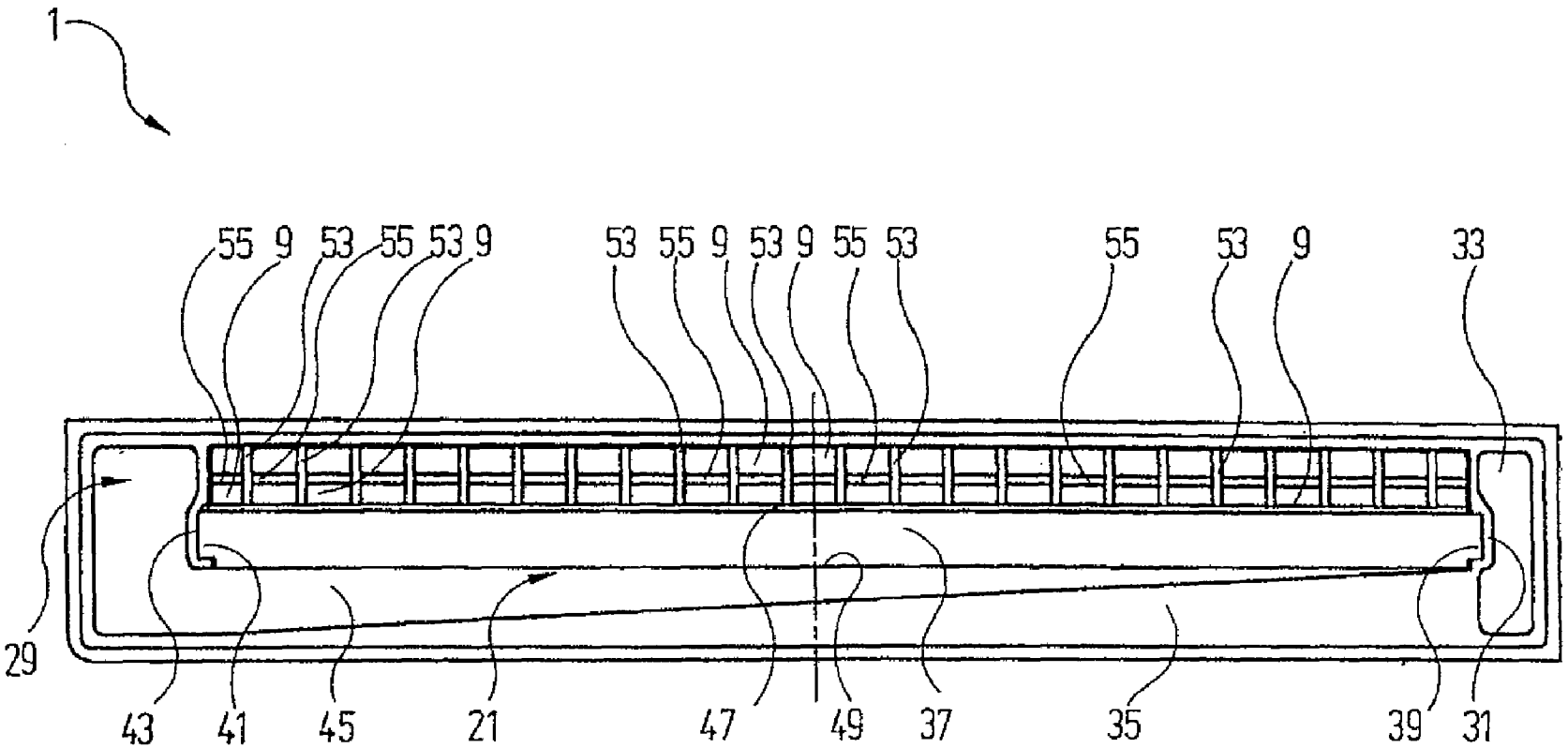
FIG. 8 shows schematically the rear view of the water-outflow housing of FIG. 5.
Figure 9:
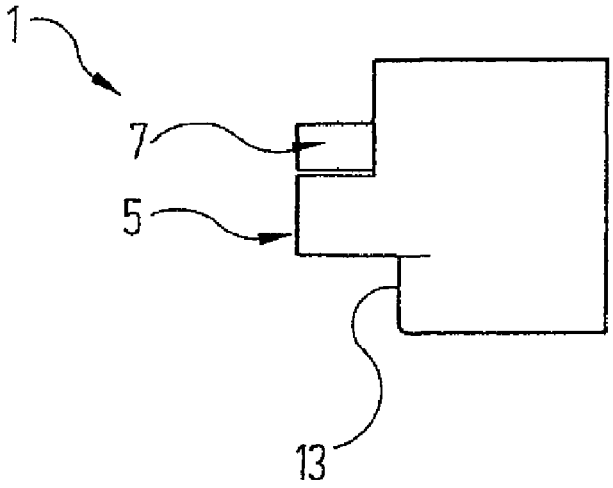
FIG. 9 shows schematically the right-hand side view of the water-outflow housing of FIG. 5.

In FIGS. 1 to 11 is shown an elongate square water-outflow housing, provided as a whole with the reference numeral 1, of a bathtub-filling mixer unit, otherwise not shown.

The water-outflow housing 1 is horizontally arranged in its longitudinal direction, for example in a flush-mounted receiver, not shown. The water-outflow housing 1 is compact perpendicular to the mounting wall, i.e. its horizontal depth in FIGS. 9 to 11 from left to right is markedly smaller than its horizontal length in FIGS. 7 and 8 from right to left. Its vertical height corresponds approximately to its horizontal depth.

The water-outflow housing 1 has, formed on the longitudinal side, on a vertical external wall 3, to the left in FIG. 1, an elongate horizontally extending receiver 5, which is U-shaped in profile and open at the front for a plate-shaped water outflow, not shown, which is wide in the horizontal direction. The receiver 5 is upwardly defined by an integrally formed, approximately rectangular, elongate water-outflow strip 7 with a plurality of water outlet channels 9. The water-outlet channels 9 lead from a distributor chamber 11 in the inside of the water outflow housing 1. The water-outflow strip 7 is, visible in FIGS. 3 and 5, slightly shorter in the longitudinal direction than the lower leg of the U-shaped receiver 5. The distance from the sides of the water-outflow strip 7 to the lateral front faces 13 of the receiver 5 corresponds approximately to the distance from its lower face to the horizontal lower side 15 of the receiver 5.

In the fully assembled state, the plate-shaped water outflow, not shown, is inserted between the receiver 5 and the water-outflow strip 7 and fixed with a plurality of clamping lugs 17 which are located on the horizontal lower side 15 of the receiver 5. In this connection, upwardly projecting projections formed on the water outflow engage around the lateral front faces of the water-outflow strip 7.

As a whole, the water-outflow housing 1 fulfils the function of a jet former for a water-outlet jet which has a wide surface area in the horizontal direction which, indicated in FIG. 1 by arrows 19, may be supplied to the water outflow, not shown. The width of the water-outlet jet 19 is predetermined by the distance between the two outer water-outlet channels 9, i.e. approximately by the extension of the water-outflow strip 7 in the longitudinal direction of the water-outflow housing 1.

Figure 10:
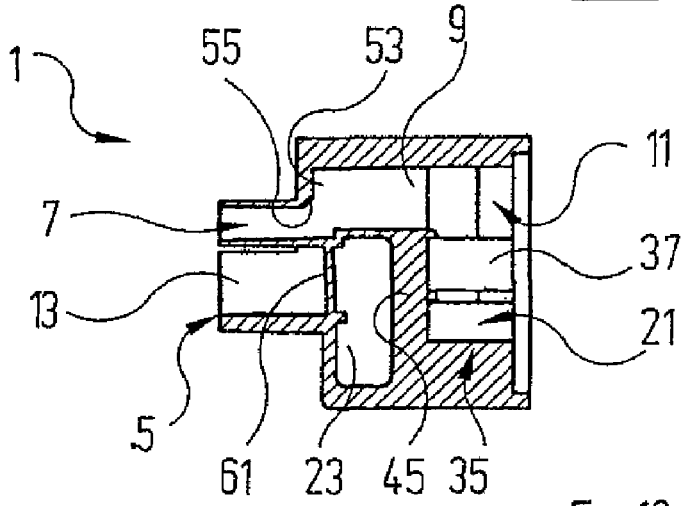
FIG. 10 shows schematically a cross section of the water-outflow housing of FIG. 5 along the line X-X there.
Figure 11:
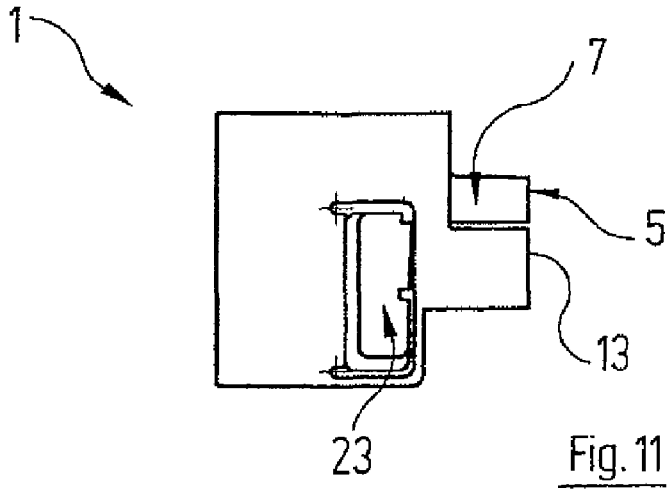
FIG. 11 shows schematically the left-hand side view of the water-outflow housing of FIG. 5.

The inside of the water-outflow housing 1 is divided in the longitudinal direction substantially into three spaces extending parallel to one another and respectively rectangular in cross section, namely into a supply channel 21, in FIG. 1 and in cross section to the bottom right in FIG. 10, the distributor chamber 11 at the top in FIGS. 1 and 10, and a lamp receiving space 23 separated spatially from the first two, to the bottom left in FIG. 1. The supply channel 21, the distributor chamber 11 and the lamp receiving space 23 are in the longitudinal direction of the water-outflow housing 1 approximately as long as the width of the water-outlet jet 19, i.e. approximately as long as the water-outflow strip 7.

The water-outflow housing 1 is closed on the side remote from the receiver 5 for the water outflow, to the rear in FIG. 1, by a removable rectangular rear wall 25. Looking towards the rear face, to the left, the rear wall 25 has a feed pipe 27. The feed pipe 27 is connected via a water pipe, not shown, to a mixer unit, also not shown.

In the water outflow housing 1 an ante-chamber 29 is arranged behind the feed pipe 27 extending over the entire vertical internal height of the water-outflow housing 1. The horizontal extension of the ante-chamber 29 in the longitudinal direction of the water-outflow housing 1 is approximately one fifteenth of the horizontal internal length of the water-outflow housing 1. Its horizontal depth is approximately half of the horizontal depth of the water-outflow housing 1.

The supply channel 21 with a rectangular cross section leads out of the ante-chamber 29, at the bottom in FIG. 1. Its horizontal depth corresponds to that of the antechamber 29. At its end opposing the ante-chamber 29 the supply channel 21 is defined by a vertical dividing wall 31, visible in FIGS. 4, 7 and 8. Between the dividing wall 31 and the adjacent side wall of the water-outflow housing 1 is located a closed, approximately cuboidal hollow space 33 which extends over the entire vertical internal height of the water-outflow housing 1 and approximately a thirtieth of the horizontal internal length of the water-outflow housing 1. The vertical height of the supply channel 21 at its end adjacent to the antechamber 29 is approximately a third of the vertical internal height of the ante-chamber 29.

The base of the supply channel 21 is formed by a stop wedge 35, the surface thereof extending obliquely upwards away from the ante-chamber 29 and being sealed against the dividing wall 31 towards the hollow space 33 at the end of the supply channel 21 by means of the top thereof.

The top of the supply channel 21 is formed by a removable elongate intermediate wall 37 made as an insert, which has an almost square cross section. The intermediate wall 37 extends over the entire horizontal length of the supply channel 21 and separates said supply channel from the similarly long distributor chamber 11. The intermediate wall 37 is inserted from the rear face of the water outflow housing 1 with one of its short sides into a horizontal guide groove 39, visible in FIGS. 4 and 8, in the dividing wall 31 of the hollow space 33 and with the opposing short side into a horizontal guide groove 41, visible in FIGS. 1, 4 and 8, in a vertical defining wall 43 of the ante-chamber 29; the intermediate wall 37 is not shown in FIG. 4 for the sake of clarity. The two guide grooves 39 and 41 are located at the same height, so that the intermediate wall 37 as a whole extends horizontally.

On a defining vertical wall 45 of the supply channel 21 remote from the rear wall 25, are located two narrow horizontal guide projections 47 and 49 for the intermediate wall 37. The lower guide projection 49, visible in FIG. 8, extends between the respective lower sides of the two guide grooves 39 and 41. The upper guide projection 47 extends parallel to the lower guide projection 49 at a distance which corresponds to the vertical height of the intermediate wall 37.

The intermediate wall 37, visible in FIG. 1, has a plurality of straight throughflow holes 51. The throughflow holes 51 extend perpendicular, i.e. in the vertical direction, through the intermediate wall 37 and connect the supply channel 21 to the distributor chamber 11. The throughflow holes 51 are arranged over the entire horizontal extension of the intermediate wall 37 in rows offset to one another. The throughflow holes 51 have respectively a diameter in the millimeter range.

The distributor chamber 11 is divided into two regions in the direction of the horizontal depth of the water-outflow housing 1. The region facing the rear wall 25 is located above the intermediate wall 37 and comprises the horizontal extension thereof. The region facing the water outflow has a plurality of vertical vertical dividing walls 53 extending transversely to the longitudinal direction of the water-outflow housing 1, which respectively separate from one another two of the approximately square water-outlet channels 9 located adjacent to one another. The water-outlet channels 9 extend, therefore, perpendicular to the throughflow holes 51.

Each water-outlet channel 9 has over approximately half its length a beveled step which leads to a narrowing 55 penetrating the water-outflow strip 7.

Below the region of the distributor chamber 11 comprising the dividing walls 53, the cuboidal lamp receiving space 23 is located at the same height as the supply channel 21, in which lamps, not visible in the figures, are accommodated. The lamps are able to be controlled via control electronics 57 visible in FIG. 2. The control electronics 57 are functionally connected via a control cable 61 to an actuating device, not shown, of the bathtub-filling mixer unit. The control cable 61 passes in a sealed manner out of an opening 59 on the side of the water-outflow housing 1 comprising the hollow space 33. The opening 59 extends over the entire cross section of the lamp receiving space 23.

The lamp receiving space 23 has an elongate light window 61 facing the water outflow. The light window 61 is a transparent part of the vertical wall 3 visible in FIG. 1 in the region between the lower side of the water outflow strip 7 and the horizontal lower side 15 of the receiver 5 for the water outflow. The light radiated by the lamp passes through the light window 61 to the front face of the water outflow consisting of transparent material and/or to the water-outlet jet 19. The light spreads through the water outflow and preferably emerges on the front faces thereof, partially also on the upper and lower main surface and thereby illuminates the water-outlet jet 19.

The invention is not restricted to use in connection with a bathtub-filling mixer unit. Instead, it may also be used with other sanitary water-outflow fittings, for example a surge flow shower head.

The water-outflow housing 1 may also be arranged obliquely instead of horizontally. The water-outlet jet 19 may be of wide surface area in an oblique direction, rather than of wide surface area in the horizontal direction.

The intermediate wall 37 may also be fixedly connected to the water-outflow housing 1 instead of as an insert.

The distributor chamber 11 may also have just one single, wide water-outlet channel instead of a plurality of water-outlet channels 9.

The throughflow holes 51 may also be of honeycombed configuration or be arranged in an unstructured manner instead of being located in a linear manner.

The supply channel 21 and/or the distributor chamber 11 may also have a differently shaped cross section, for example a different polygonal, round or oval cross section instead of a rectangular cross section.

The throughflow holes 51 may also extend obliquely, rather than perpendicularly, through the intermediate wall 37. Similarly, the water-outlet channels 9 may also extend obliquely to the throughflow holes 51.

The throughflow holes 51 may also be of a different shape, for example polygonal, round or oval, instead of rectangular.

Instead of the step-shaped narrowings 55 the water-outlet channels 9 may also have no narrowings or a different type of narrowing, for example a funnel-shaped narrowing.

The lamp receiving space 23 may also be dispensed with. However, a plurality of lamp receiving spaces may also be provided at various points of the water-outflow housing 1. Each lamp receiving space 23 may also have a plurality of light windows in different directions.

The invention claimed is:

1. A sanitary water-outflow fitting having a water-outflow housing and a jet former for a wide-surface-area water-outlet jet arranged therein, wherein the water-outflow housing comprises an elongate supply channel that extends substantially perpendicular to the water-outlet jet, tapers in a funnel-shaped manner in a direction of distribution, and is bounded by an intermediate wall, wherein the intermediate wall comprises a plurality of throughflow holes via which the supply channel is connected to an elongate distributor chamber substantially parallel thereto, and wherein the elongate distributor chamber has at least one water-outlet channel leading to the water outflow, wherein the supply channel and the distributor chamber have a rectangular cross section, the throughflow holes extend perpendicular through the intermediate wall, and the water-outlet channel extends perpendicular to the throughflow holes.

2. A sanitary water-outflow fitting according to claim 1, wherein the supply channel, the intermediate wall and the distributor chamber are approximately as long as the width of the water-outlet jet and the throughflow holes are distributed over the entire surface of the intermediate wall.

3. A sanitary water-outflow fitting according to claim 1, wherein the throughflow holes are located offset to one another on parallel lines.

4. A sanitary water-outflow fitting according to claim 1, wherein the throughflow holes are of a honeycombed configuration.

5. A sanitary water-outflow fitting according to claim 1, wherein a plurality of water-outlet channels are arranged adjacent to one another.

6. A sanitary water-outflow fitting according to claim 5, wherein the plurality of water-outlet channels are rectangular.

7. A sanitary water-outflow fitting according to claim 1, wherein the at least one water-outlet channel has at least one narrowing region in the direction of water flow.

8. A sanitary water-outflow fitting according to claim 7, wherein the at least one narrowing region becomes narrower in a step-like configuration.

9. A sanitary water-outflow fitting according to claim 7, wherein the at least one narrowing region becomes narrower in a funnel-shaped configuration.

10. A sanitary water-outflow fitting according to claim 1, wherein the intermediate wall is an insert.

11. A sanitary water-outflow fitting according to claim 1, wherein the water-outflow housing has at least one lamp receiving space with at least one light window facing the water outflow.

12. A sanitary water-outflow fitting according to claim 1, and configured as a bathtub-filling mixer unit.

13. A sanitary water-outflow fitting having a water-outflow housing and a jet former for a wide-surface-area water-outlet jet arranged therein, wherein the water-outflow housing comprises an elongate supply channel that extends substantially perpendicular to the water-outlet jet, tapers in a funnel-shaped manner in a direction of distribution, and is bounded by an intermediate wall, wherein the intermediate wall comprises a plurality of throughflow holes via which the supply channel is connected to an elongate distributor chamber substantially parallel thereto, and wherein the elongate distributor chamber has at least one water-outlet channel leading to the water outflow, wherein the at least one water-outlet channel has at least one narrowing region in the direction of water flow, and wherein the at least one narrowing region becomes narrower in a step-like configuration.

14. A sanitary water-outflow fitting according to claim 13, wherein the supply channel, the intermediate wall, and the distributor chamber are approximately as long as the width of the water-outlet jet and the throughflow holes are distributed over the entire surface of the intermediate wall.

15. A sanitary water-outflow fitting according to claim 13, wherein the throughflow holes are located offset to one another on parallel lines.

16. A sanitary water-outflow fitting according to claim 13, wherein the throughflow holes are of a honeycombed configuration.

17. A sanitary water-outflow fitting according to claim 13, wherein the at least one water-outlet channel comprises a plurality of water-outlet channels.

18. A sanitary water-outflow fitting according to claim 17, wherein the plurality of water-outlet channels are rectangular.

19. A sanitary water-outflow fitting according to claim 13, wherein the water-outflow housing has at least one lamp receiving space with at least one light window facing the water-outflow.

20. A sanitary water-outflow fitting according to claim 13, and configured as a bathtub-filling mixer unit.

* * * * *